US006844531B2

(12) United States Patent
Kirby

(10) Patent No.: US 6,844,531 B2
(45) Date of Patent: Jan. 18, 2005

(54) CONDUIT READY ELECTRIC BELLY-BAND HEATER AND METHOD OF USE

(75) Inventor: Robert Kirby, Sparta, TN (US)

(73) Assignee: Tutco, Inc., Cookeville, TN (US)

( * ) Notice: Subject to any disclaimer, the term of this patent is extended or adjusted under 35 U.S.C. 154(b) by 48 days.

(21) Appl. No.: 10/463,413

(22) Filed: Jun. 18, 2003

(65) Prior Publication Data

US 2004/0256379 A1 Dec. 23, 2004

(51) Int. Cl.[7] ..... H05B 3/58

(52) U.S. Cl. ..... 219/535; 219/544; 219/546; 219/541

(58) Field of Search ..... 219/535, 525, 219/546, 548, 549, 528, 544, 541; 29/611; 138/104; 165/46

(56) References Cited

U.S. PATENT DOCUMENTS 3,730,262 A * 5/1973 Drugmand ..... 165/46
3,912,907 A * 10/1975 Lodi ..... 219/535
3,981,053 A * 9/1976 Kreuzer ..... 24/274 R
4,356,624 A * 11/1982 Coverstone et al. ..... 29/611
4,695,712 A * 9/1987 Busch ..... 219/535
5,359,179 A * 10/1994 Desloge et al. ..... 219/535
5,667,712 A * 9/1997 Sutorius et al. ..... 219/535
5,714,738 A * 2/1998 Hauschulz et al. ..... 219/535
6,054,691 A * 4/2000 McGwire ..... 219/535
6,147,331 A * 11/2000 Still et al. ..... 219/525
6,390,136 B1 * 5/2002 Hutchins et al. ..... 138/109

* cited by examiner

*Primary Examiner*—Robin O. Evans
*Assistant Examiner*—Leonid Fastovsky
(74) *Attorney, Agent, or Firm*—Clark & Brody

(57) ABSTRACT

An electric belly-band heater includes at least one conduit fitting housing. The housing is located on the heater to surround one or more lead wires and provide a securement point for a conduit end. The conduit end can be secured to the housing using the appropriate fittings so that the lead wire exiting the heater sheath is totally encased in the conduit to meet installation codes.

20 Claims, 4 Drawing Sheets

CONDUIT READY ELECTRIC BELLY-BAND HEATER AND METHOD OF USE

FIELD OF THE INVENTION

The present invention is directed to a conduit ready electric belly-band heater, and in particular, to a heater that has one or more conduit fitting housings that permit easy conduit attachment for lead wire protection.

BACKGROUND ART

The use of electric belly-band heaters is well known in the prior art. Typically, these heaters use resistance heating wherein a resistance heating wire is encased in a metal sheath. The metal sheath is in contact with the item or material to be heated. One type of belly-band heater (commonly referred to as a "crankcase heater", "compressor heater" or "sump heater") is used to heat refrigeration compressors or air-conditioning compressors. The heater employs a standard hose clamp for attachment to the compressor. The standard hose clamp is cut in two pieces with each piece affixed (welded for example) to opposite ends of the heater's metal sheath. Assembly of the heater to the compressor is accomplished by engaging the two ends of the clamp as intended and then tightening the assembly around the selected compressor location. This type of heater construction can also be used for heating containers such as barrels, heating pipes, etc.

The belly-band heater has an insulated electric lead wire exiting each end of the metal sheath. A frequent requirement in the use of these heaters is for the lead wires to be routed in standard metal conduit. Further, it is often required that the conduit enclose the lead wires from the point where each lead exits the heater sheath to where the lead wires enter an electrical junction box or boxes.

FIG. 1 shows a typical electric belly-band heater designated by the reference numeral 10 and including the hose clamp pieces 1 and 3, and the screw mechanism 5. A metal sheath 7 extends between the two pieces 1 and 3, with the hose pieces attached to the sheath by welding or the like. The metal sheath 7 encases an electrically insulated resistance heating wire 9 and includes a fluted strip portion 8, which interfaces with the equipment or material requiring heating. The wire 9 exits the metal sheath 7 as a pair of lead wire ends 11 for encasing in conduit and/or connection to the appropriate electrical power source and controls.

Presently, the requirement of encasing the lead wires in conduit is achieved by attaching specialized parts/items where the heater is being used so as to protect the lead wires and meet installation codes. This procedure is both time-consuming and costly. In conjunction with the special rigging required to meet the requirement of enclosing the lead wires at the heater itself, opposite ends of the conduit would also be attached to standard junction boxes or the like.

In light of the difficulties in enclosing the lead wires emanating from an electric belly-band heater, a need exists for improvements in this area to reduce costs and time of installation. The present invention solves this need by providing an improved electric belly-band heater, wherein the heater utilizes a conduit fitting housing made as part of the heater itself. Once the heater is installed at a desired location, the appropriate conduit fittings and conduit can easily be connected to the heater to encase the lead wires, thus avoiding the need for any special rigging or costly modifications.

SUMMARY OF THE INVENTION

A first object of the present invention is an improved electric belly-band heater.

Another object of the invention is a belly-band heater that employs a conduit fitting housing that enables easy and rapid conduit connection.

Yet another object of the invention is a belly-band heater that uses one or two conduit fittings.

A still further object of the invention is a method of encasing lead wires of an electric belly-band heater in a conduit fitting or conduit.

Other objects and advantages of the present invention will become apparent as the description thereof proceeds.

In satisfaction of the foregoing objects and advantages, the present invention is an improvement in belly-band heaters that use a metal sheath and hose clamp arrangement for heating a particular material or component. The present invention modifies these types of heaters with a conduit fitting housing that is mounted or affixed to the heater itself. The improvement comprises one or more conduit fitting housings mounted to the heater and adapted to cover portions of one or both lead wires when exiting the metal sheath. The conduit fitting housing includes an opening adapted to receive a conduit fitting to facilitate conduit attachment to the conduit fitting housing and conduit encasement of one or both lead wires.

The conduit fitting housing can be mounted or affixed to the heater in any way, with a preferred mode being welding to portions of at least the hose clamp assembly. Alternatively, the conduit fitting housing is affixed to portions of the hose clamp assembly and the metal sheath.

In instances where both lead wires extend from the metal sheath in the same location, a single housing can be employed. In instances where the lead wires extend from opposite ends of the metal sheath, a pair of conduit housings can be utilized.

In a preferred embodiment, the housing has a top portion having the opening therein and a side wall, the side wall and the top portion forming a space to receive a portion of the conduit fitting. Flanges extending from the side wall are provided to facilitate affixing the housing to the heater. The housing can be cylindrical with one side wall, or have a number of sides such as a cube. One of the side walls can employ a recess or cutout and, optionally split flanges, to accommodate attachment to the metal sheath due to the raised hump in of the metal sheath caused by the encased resistance wire.

BRIEF DESCRIPTION OF THE DRAWINGS

Reference is now made to the drawings of the invention wherein.

DESCRIPTION OF THE PREFERRED EMBODIMENTS

The present invention offers significant advantages in the use and installation of electric belly-band heaters.

Previously, special rigging or modifications were required to ensure that the lead wires of the heater were encased in conduit. With the present invention, no modifications or rigging is required to ensure that the lead wires are conduit encased. With the inventive heater, an installer only has to feed the lead wire or wire through the conduit fitting, and position the conduit fitting in the fitting housing. With the lead wires also fed into the appropriate conduit, the end of the conduit in then clamped in place. The installation time as well as installation costs are greatly reduced.

Figure 1:
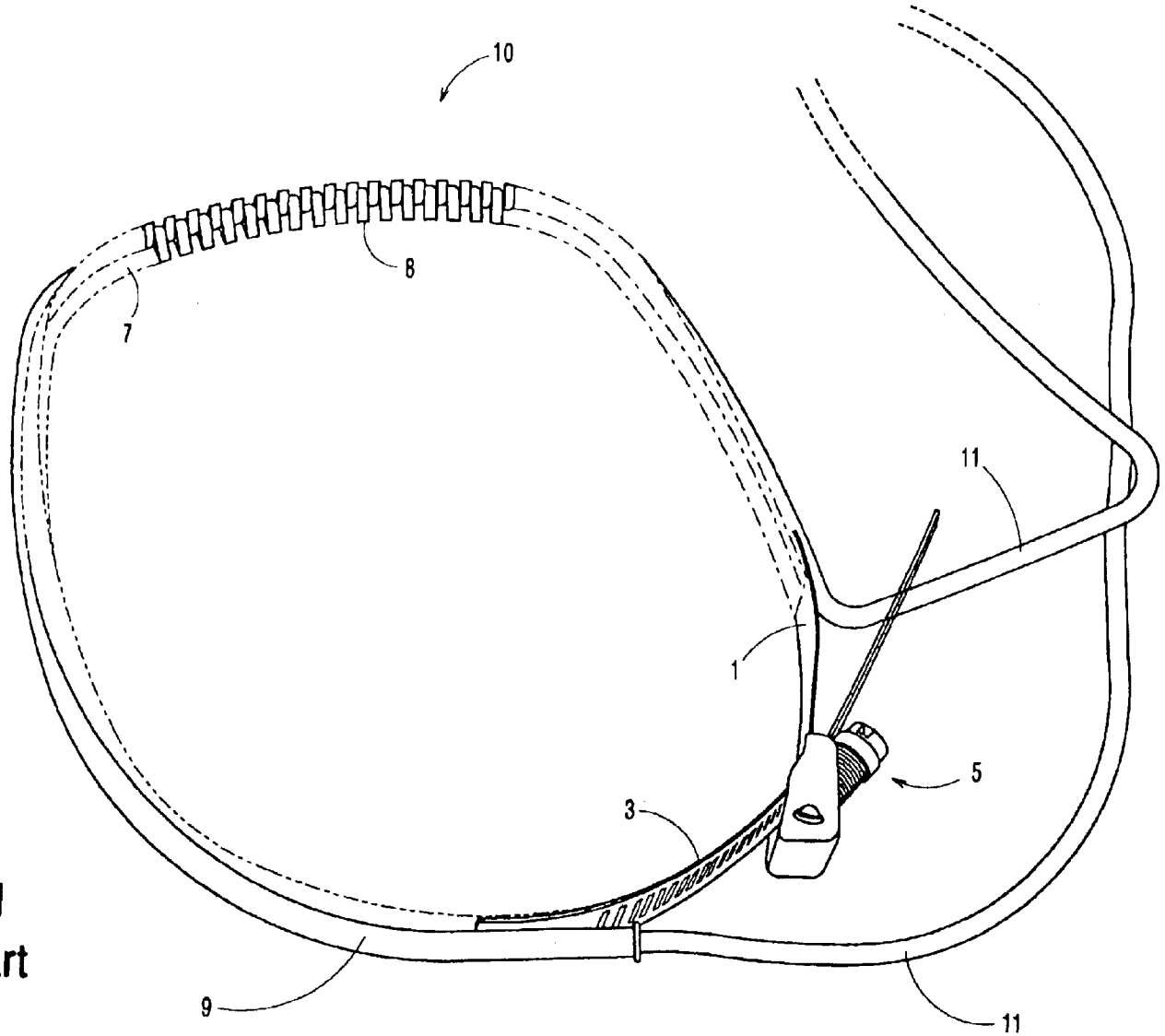
Fig. 1 Prior Art
FIG. 1 is a perspective view of a prior art electric belly-band heater.
Figure 2:
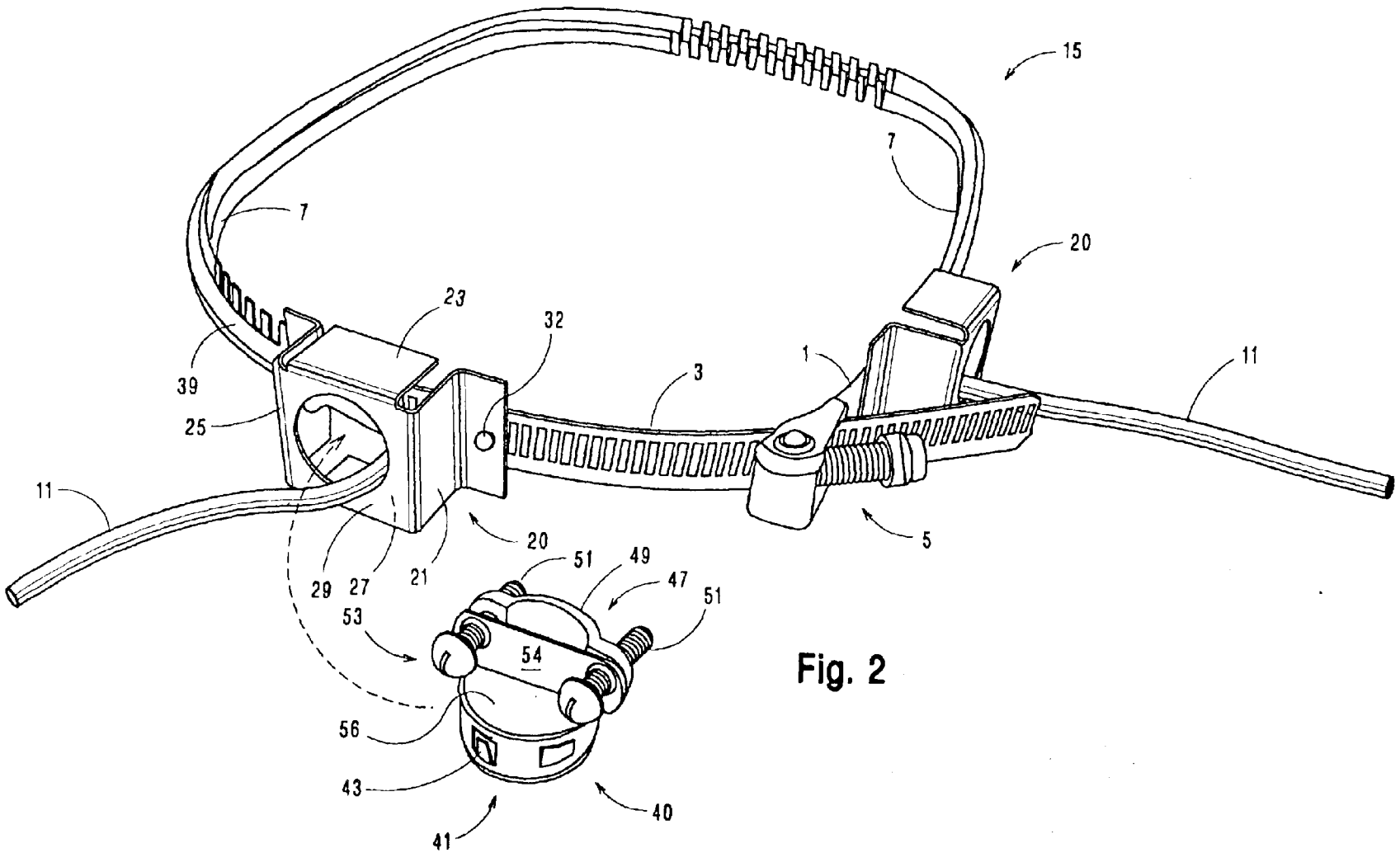
FIG. 2 is a perspective view of a first embodiment of the electric belly-band heater of the invention.
Figure 3:
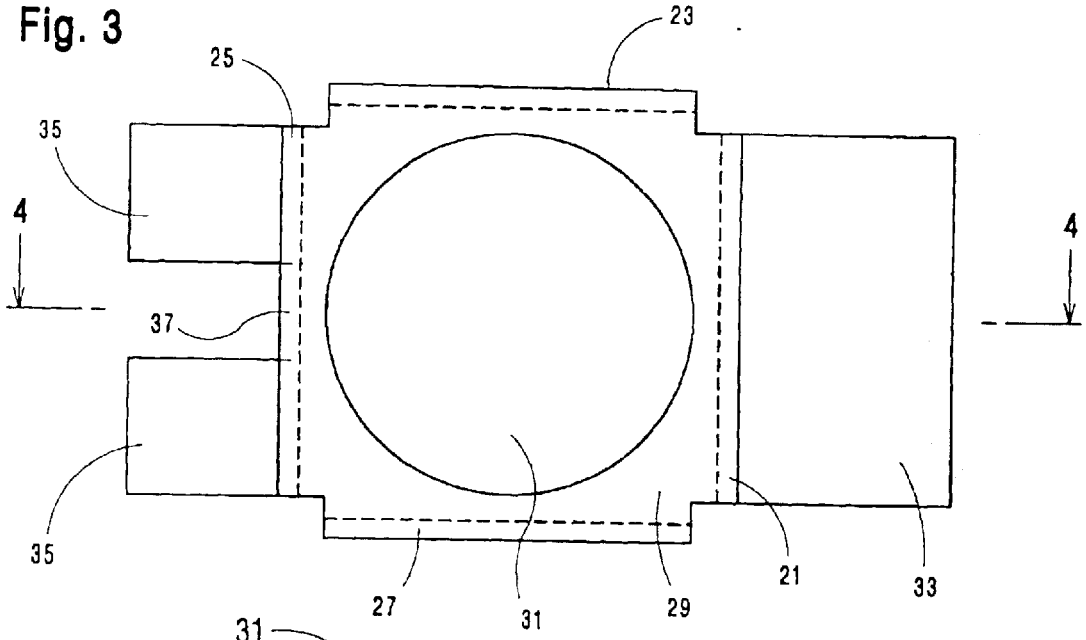
FIG. 3 is a top view of the conduit fitting housing of FIG. 2.
Figure 4:
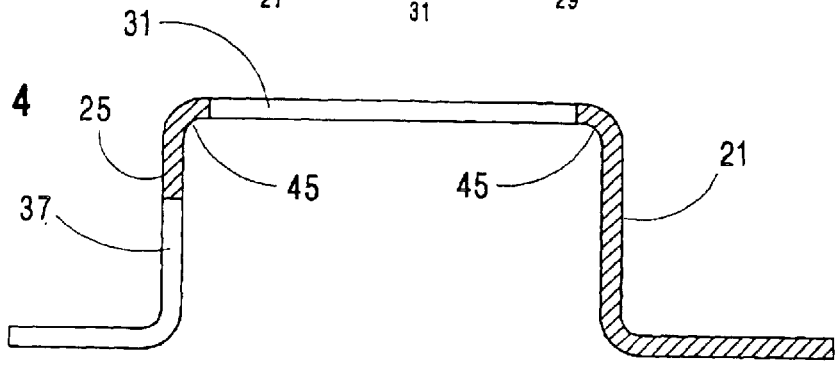
FIG. 4 is a sectional view along the line 4—4 of FIG. 3.

Referring to FIG. 2, one heater embodiment of the invention is designated by the reference numeral 15, and is similar to that shown in FIG. 1 in terms of the hose clamp pieces 1 and 3, the screw mechanism 5, the metal sheath 7, the encased wire 9, and lead wire ends 11.

The inventive heater 15 also includes a pair of conduit fitting housings 20, each positioned on the heater where the wire 9 exits the metal sheath to form the lead wires 11. The housings 20 also shield the exposed lead wire ends in this vulnerable area. Another purpose of the housing 20 is to provide an easy way to protect the lead wire ends 11 with conduit as may be required during installation of the heater 15. The housing 20 is designed so that the appropriate conduit fitting can interface with the housing thereby permitting conduit to be connected to the fitting for encasing the lead wire ends 11. While the housing is configured to interface with one particular type of fitting as described below, it could take on other shapes to accommodate other types of fittings and conduits.

Referring now to FIGS. 2–5, the housing 20 is cube-shaped with four side walls 21, 23, 25, 27, and a top portion 29. The top portion 29 has an opening 31 therein, the opening 31 allowing for connection with a conduit fitting, and passage of the lead wire ends 11 to the appropriate location to receive power.

While the housing 20 can be attached to the heater 10 in any fashion, one way is through the use of flanges and welding, preferably spot welding. FIG. 2 shows a spot weld 32 wherein the housing 20 is attached to the hose piece 3. Although not visible, similar welding is made on the other side of the housing 20. Of course, other modes of attachment could be employed such as mechanical fasteners, crimping or the like, or combinations thereof.

Two of the side walls 21 and 25 of each housing 20 are adapted for attachment to the metal sheath 7 and/or hose pieces 1,3 by the inclusion of flanges. Wall 21 has a single flange 33 that is attached to hose piece 1, and wall 25 has two flanges 35 for attachment to the metal sheath 7. The wall 25 also has a cutout portion 37, which provides a clearance for the wire portion 39 of the metal sheath 7. Since the wire portion 39 only passes through one side of the housing 20, a single flange 33 can be used on the other side. While the flanges are shown attached to both a hose piece and the metal sheath, the attachment of the housing could vary depending on the configuration of the heater. For example, a given housing may be attached to the hose piece only. Furthermore, the wall 25 containing the two flanges could employ other flange arrangements for attachment to the heater, e.g., a single flange formed with a concave recess on an underside thereof to accommodate the wire portion of the sheath.

Figure 5:
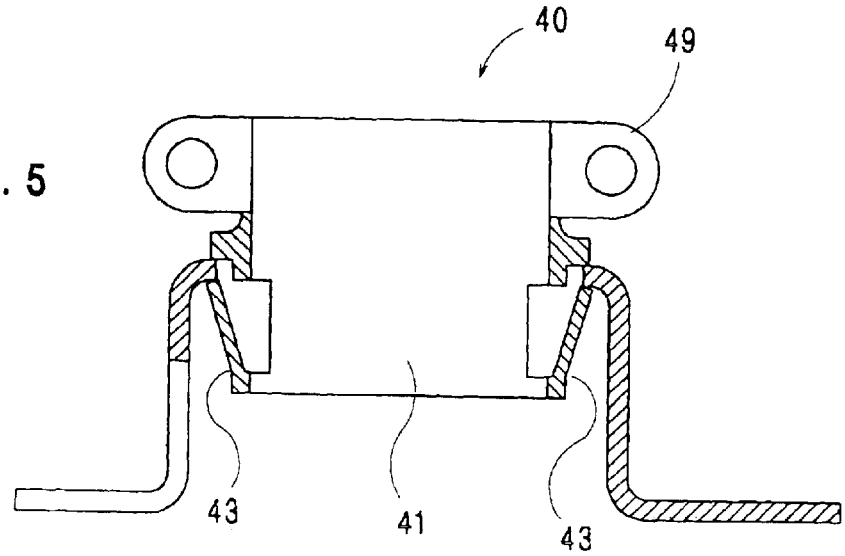
FIG. 5 is a sectional view of the conduit housing of FIG. 3 and a conduit fitting.
Figure 6:
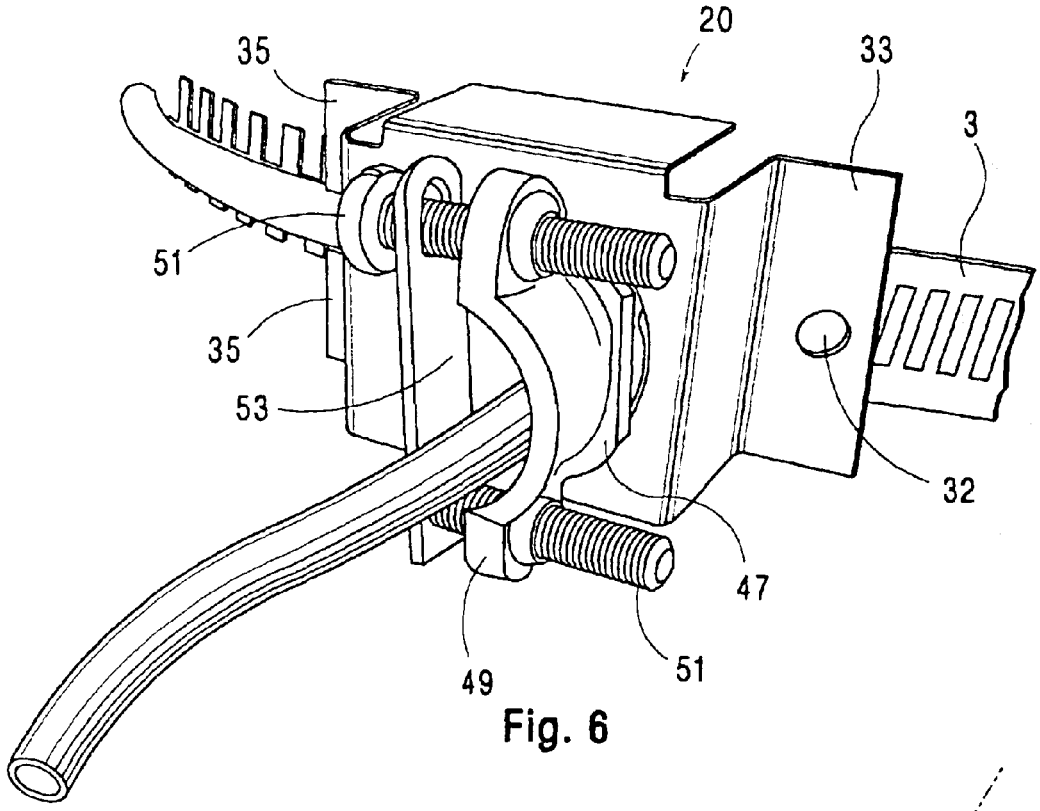
FIG. 6 is an enlarged perspective view of the FIG. 2 embodiment showing the conduit fitting interfaced with the conduit fitting housing.

The opening 31 in the top portion 29 of the housing 20 is sized to interface with a conduit fitting 40 shown in FIGS. 2, 5, and 6. FIG. 5, as described below, especially shows how the conduit fitting is secured to the housing and interfaces with the lead wire end 11.

The fitting 40 is a standard type having a female portion 41, which fits through the opening 31 in the housing 20, is internally threaded, and has tabs 43 along its periphery. The tabs 43 are depressed when the female portion passes through the opening 31. Once the tabs 43 pass through the opening 31, they rebound to their original orientation and provide a stop against an underside 45 of the top portion 29 (see FIG. 4) to retain the female portion 41 within the housing 20. The male portion 47 of the conduit fitting 40 is then threaded into the female portion 41. The male portion 47 also has a clamp portion 49, which assists in securing conduit to the conduit fitting 40 once the lead wire end 11 or ends are fed through the conduit for connection at their free ends. The male portion 47 uses a pair of screws 51 and clamp bar 53, which interface with the clamp portion 49 to secure wire or wire-encased conduit exiting the fitting 40. The clamp bar 53 is l-shaped with one section 54 facing the curved portion of the clamp 49, and the other section partially covering the opening of the female portion 41; the remaining opening providing space for conduit connection and/or wire end travel.

FIG. 6 shows the housing 20 coupled with a fitting 40, with FIG. 5 showing a sectional view of the conduit fitting 40 in the housing 20. In the embodiment of FIG. 6, the lead wire 11 is shown exiting the housing 20 and fitting 40.

Figure 7:
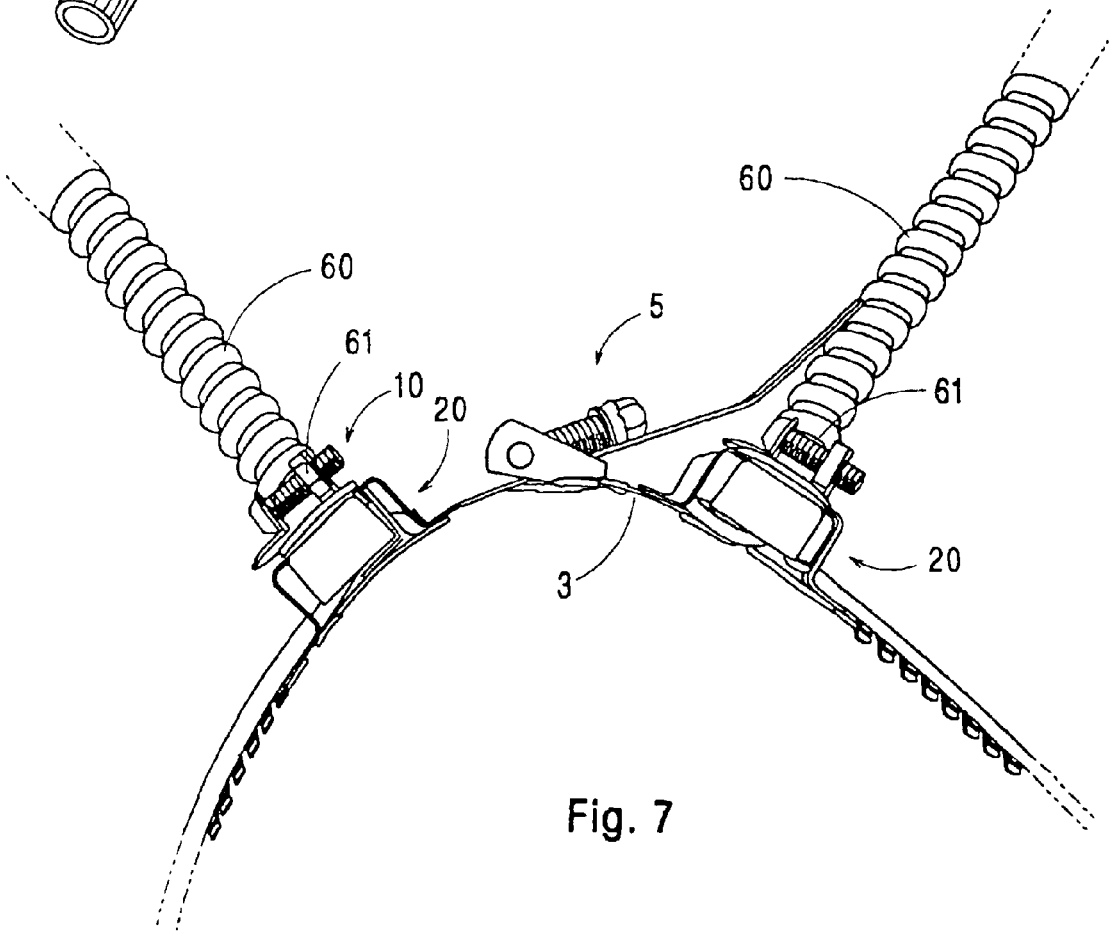
FIG. 7 is a perspective view of the FIG. 2 embodiment with conduit fitting and conduits attached to each conduit fitting housing.

FIG. 7 shows a pair of housings 20 and fittings 40 assembled together, with an end 61 of each conduit 60 clamped to the fittings 40. Although not shown, the other ends of conduit 60 would be connected to another fitting or the like, and the ends of the lead wires 11 would be attached so that power can be supplied to the heater 15.

The housing is preferably made using metal plate material that is cut/stamped to form the side wall sections with flanges where necessary, and the opening. The thus-formed sections are bent to create the cube shape. While a cube shape is shown, other shapes could be used. For example, the housing could be cylindrical in shape with one side wall, with the flanges located in the appropriate locations along the side wall.

While the heater is illustrated with a pair of conduit fitting housings, the heater could be configured such that the lead wire ends 11 exit the sheath 7 at the same location, and only one conduit fitting housing would be necessary for encasing both lead wire ends 11 in conduit. Also, while one type of belly-band heater is illustrated, any type of a heater that would be in the form of a band capable of being tightened could employ the conduit fitting housing.

It should be understood that the inventive heater can be used in virtually any application that would require a band heater. Examples include equipment such as compressors, but other applications such as pipes, containers, fluid-containing reservoirs could also use the heater of the invention.

While a particular type of conduit fitting is shown, any type that will interface with conduit and the fitting housing is adaptable for the invention.

In an exemplary use, one or more housings would be first mounted to the heater depending on the location of the lead wire ends. Assuming the heater design of FIG. 1, two housings are used, and each lead wire end 11 extends through the opening 31 after the attachment. The heater could then be installed in its desired location. Then, the coupling fitting 40 is installed so that it is secured to the housing 20, with the lead wire end 11 passing through the interior of each portion of the coupling. Then, the lead wire is fed through the desired conduit, and the conduit end is clamped to the male portion of the coupling fitting. The lead wire ends are then linked to other wires, or a source of power. Of course, the coupling fitting 40 could be installed prior to installation of the heater, and the heater could then be installed. Alternatively, the heater could be installed after the conduit fitting and conduit are linked to the heater.

As such, an invention has been disclosed in terms of preferred embodiments thereof which fulfills each and every one of the objects of the present invention as set forth above and provides a new and improved electric belly-band heater and method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In an electric belly-band heater having a metal sheath encasing an insulated electric resistance heating wire, and a hose clamp assembly attached to ends of the metal sheath for securing the metal sheath to a component for heating purposes, the insulated electric resistance heating wire extending from the metal sheath to form a pair of lead wires, the improvement comprising at least one conduit fitting housing mounted to the heater and adapted to cover portions of one or both lead wires when exiting the metal sheath, the at least one conduit fitting housing including an opening adapted to receive a conduit fitting to facilitate conduit attachment to the conduit fitting housing and conduit encasement of one or both lead wires.

2. The heater of claim 1, wherein the conduit fitting housing is welded to portions of at least the hose clamp assembly.

3. The heater of claim 1, wherein the conduit fitting housing is welded to a portion of the hose clamp assembly and a portion of the metal sheath.

4. The heater of claim 1, wherein the conduit fitting housing has a side with a recess sized to interface with a portion of the metal sheath encasing the insulated electrical resistance wire.

5. The heater of claim 1, wherein the lead wires extend from each end of the metal sheath, and further comprising a pair of conduit fitting housings, each covering a respective end of the metal sheath.

6. The heater of claim 5, wherein each conduit fitting housing is welded to a portion of the hose clamp assembly and a portion of the metal sheath.

7. The heater of claim 5, wherein the conduit fitting housing is welded to a portion of the hose clamp assembly and a portion of the metal sheath.

8. The heater of claim 1, wherein the housing further comprises:

a top portion having the opening therein;

at least one side wall, the at least one side wall and the top portion forming a space to receive a portion of the conduit fitting; and at least a first flange extending from one location on the at least one side wall, and at least a second flange extending from another location on the at least one side wall, the first flange attached to a portion of the metal sheath with the second flange attached to a portion of one of the hose pieces.

9. The heater of claim 8, further comprising a pair of spaced apart first flanges.

10. In a method of installing a heater in contact with a component requiring an application of heat using a belly-band heater, the heater having a metal sheath encasing an insulated electric resistance heating wire, and a hose clamp assembly attached to ends of the metal sheath for securing the metal sheath to a component for heating purposes, the insulated electric resistance heating wire extending from the metal sheath to form a pair of lead wires, the improvement comprising attaching one or more conduit fitting housings to the heater so that the pair of lead wires can be encased in conduit when exiting the one or more conduit fitting housings.

11. The method of claim 10, wherein the lead wires extend from opposite ends of the metal sheath, and a conduit fitting housing is attached at each end.

12. The method of claim 11, further comprising the step of attaching a conduit fitting to the one or more conduit fitting housings.

13. The method of claim 11, wherein the one or more conduit fitting housings are welded to the heater.

14. The method of claim 11, wherein each of the one or more conduit fitting housings are welded to a portion of the hose clamp assembly.

15. The method of claim 14, wherein each of the one or more conduit fitting housings are welded to a portion of the hose clamp assembly and a portion of the metal sheath.

16. The method of claim 12, further comprising the step of attaching conduit to the conduit fitting.

17. The method of claim 1, wherein a pair of conduit fitting housings are attached to the heater.

18. The method of claim 17, wherein the pair of conduit fitting housings are welded to the heater.

19. The method of claim 18, wherein a conduit fitting is attached to each conduit fitting housing.

20. The method of claim 19, wherein conduit is attached to each conduit fitting.

* * * * *